US005133554A

United States Patent [19]

Piccinini, Sr.

[11] Patent Number: 5,133,554

[45] Date of Patent: Jul. 28, 1992

[54] LOTTO TICKET CARD HOLDER

[76] Inventor: August D. Piccinini, Sr., 4714 Walther Ave., Baltimore, Md. 21214

[21] Appl. No.: 770,169

[22] Filed: Oct. 2, 1991

[51] Int. Cl.[5] ..... A63F 3/06

[52] U.S. Cl. ..... 273/148 R; 380/56

[58] Field of Search ..... 273/198 R, 269, 240; 434/199; 283/49, 50, 48.1; 380/56

[56] References Cited

U.S. PATENT DOCUMENTS

| | | | |
|---|---|---|---|
| 3,394,935 | 7/1968 | Beauchaine | 273/240 |
| 4,781,379 | 11/1988 | Parks | 273/148 R |
| 5,007,642 | 4/1991 | Henry et al. | 273/148 R |

FOREIGN PATENT DOCUMENTS

| | | | |
|---|---|---|---|
| 2450116 | 10/1980 | France | 273/148 R |
| 2483243 | 12/1981 | France | 273/148 R |
| 2494121 | 5/1982 | France | 273/148 R |

*Primary Examiner*—Benjamin Layno
*Attorney, Agent, or Firm*—Leonard Bloom

[57] ABSTRACT

A lotto ticket card holder for viewing numbers thereon and for comparing the viewed numbers with the current winning combination. The holder includes a front sheet and a back sheet that is joined thereto along one side edge thereof. A transverse magnifier is attached to the front sheet, so that a lotto ticket may be held and slid between the front and back sheets between the top and bottom edges thereof for viewing the respective lines of numbers printed on the ticket. A "magic slate" is provided on which the current winning combination may be noted. This "magic slate" is secured to the front sheet immediately adjacent to the magnifier, so that the viewed numbers may be easily compared with the winning combination that is noted thereon.

21 Claims, 3 Drawing Sheets

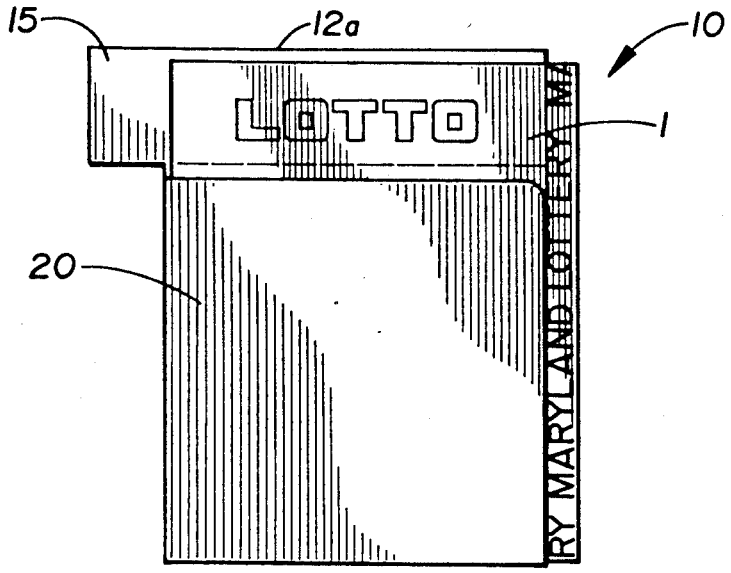
FIG. 5
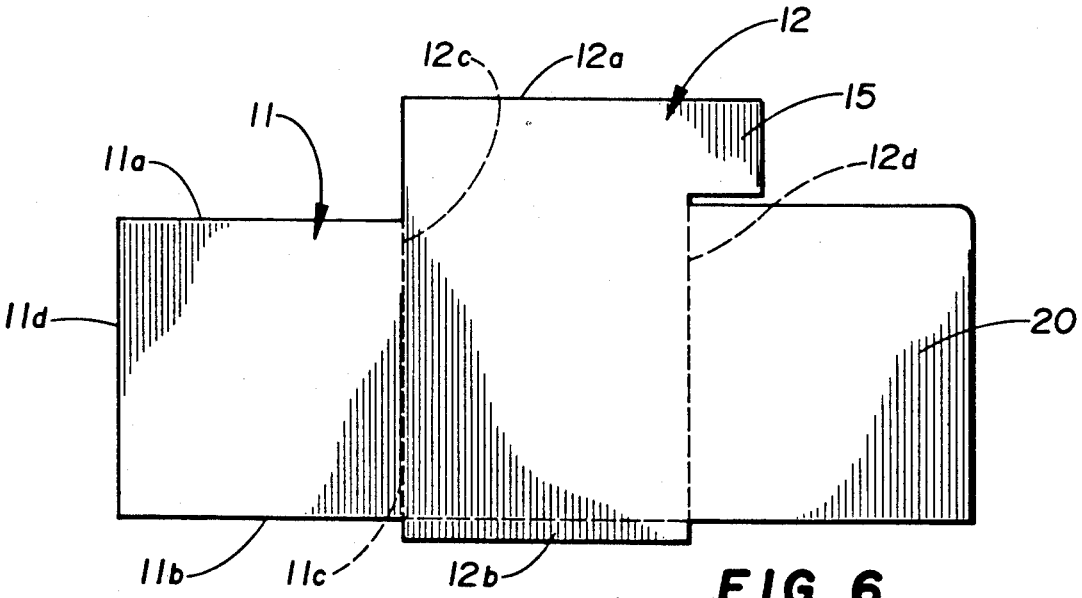
FIG. 6
FIG. 7
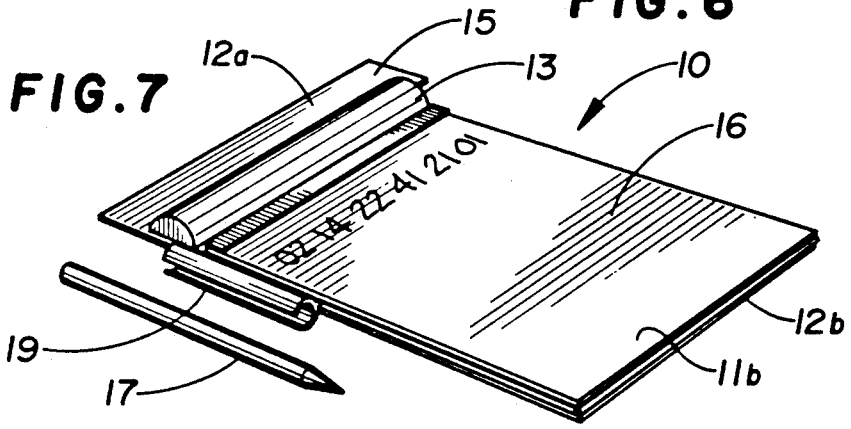

LOTTO TICKET CARD HOLDER

FIELD OF THE INVENTION

The present invention relates to devices for the holding and viewing of lottery tickets and, in particular, to such devices which facilitate the viewing of lines of numbers printed on the ticket, as well as the comparison of the viewed number to the winning combination.

BACKGROUND OF THE INVENTION

Lotto games are contests in which a series of single or double digit numbers are preselected. These numbers are then printed on lotto tickets prior to drawing.

While there are numerous variations of lotto tickets depending on the game, generally these tickets have the preselected numbers arranged one after the other in consecutive lines.

Problems are presented to the players of such games when they attempt to check each entry in that the participant has to follow the winning number across the columns to verify that he has a winning combination.

In order to aid the participants in this laborious chore, a lotto contest number checking device was disclosed in U.S. Pat. No. 4,600,198 issued to Fox. In Fox, a device is provided that has six or seven tapes each of which correspond to a two digit number. At the top of that device a series of windows are formed in a line each window being aligned with a particular tape. The tapes are rotated to place the winning combination in the windows where they may be conveniently viewed by the participant. The device may then be placed directly on the ticket for comparison purposes.

While being useful for its purposes, such a device has several moving mechanical parts to move and position the tapes for displaying the winning combination. This greatly increases the cost and complexity of such devices, a serious drawback in that such devices, by their very nature, should be as simple and inexpensive as possible. Also, such mechanical elements are readily subject to wear and tear, further increasing the potential costs associated with use of the device. Finally, such a device offers the user nothing in the way of improving the visibility the numbers printed on the lotto ticket.

U.S. Pat. No. 3,704,938 issued to Funselow, discloses a punch card viewer which includes a magnifying glass for aiding in the viewing of numbers on a punch card which are passed underneath. However, despite its longstanding existence, its principles have never been utilized for viewing the numbers on a lottery ticket. Further, it is noted that there is nothing provided which permits the number being viewed to be compared to the winning number and that if there was, the movement of the lotto card through the magnifying glass would obstruct it.

Finally, U.S. Pat. No. 488,411 issued to Wyman discloses a slate attachment for aiding spelling. In this device, the letters are arranged on eleven different tapes for displaying a desired word. In this respect, Wyman suffers from the same drawbacks relative to costs and wear and tear as those of Fox '198 noted above. A blackboard or slate is provided so that the user may attempt to write the desired word thereon. However, like the use of movable tapes, the provision of a blackboard adds weight and cost to the device.

Thus, it can be seen that there remains a need for a device for aiding in the reading or viewing of the numbers printed on a lotto ticket and for comparing the viewed number with the winning combination. There further remains a need for such a device that is simple in construction and use and which is inexpensive to fabricate.

SUMMARY OF THE INVENTION

A primary object of the present invention is to provide a lotto ticket card holder which aids in the viewing of the numbers printed on a lotto ticket and in the comparing of the viewed number with the winning combination.

A further primary object of the present invention is to provide such a device where the winning combination may be placed in close physical proximity with the numbers on the lotto ticket being viewed for comparison purposes and where the lotto ticket may be viewed without obstructing the winning combination.

It is a further object of the present invention to provide such a device which is inexpensive and simple in construction and which is easy to use.

In accordance with the teachings of the present invention, disclosed herein is a lotto ticket card holder for a lotto ticket of the type having at least one line of numbers printed thereon. The holder includes a front sheet that has a top edge, a bottom edge and a pair of parallel side edges. A back sheet is provided that has a top edge, a bottom edge and a pair of parallel side edges. The back sheet and the front sheet are joined together along at least one of the parallel side edges of each of the front and back sheets. In this manner, the lottery ticket may be held and slid between the front and back sheets from the respective top edges to the respective bottom edges thereof. A transverse magnifier is secured to the front sheet, such that as the lotto ticket is slid each line of the numbers printed on the lotto ticket is magnified by the magnifier for facilitating the viewing of the line of numbers by the user. Means is provided for noting the current winning combination. This means is secured to the front sheet substantially adjacent to the transverse magnifier, whereby easy comparison of the line of numbers on the lotto ticket being viewed and the current winning combination is facilitated.

Preferably, the transverse magnifier is secured along the top edge of the front sheet, so as to overhang the top edge.

It is further preferred that the back sheet have a substantially greater height than the front sheet, so that the back sheet of the holder extends above the top edge of the front sheet. In this fashion, lotto tickets being slid underneath the magnifier for viewing are supported.

It is still further preferred that the portion of the back sheet that extends above the top edge of the front sheet has a tab formed thereon. This tab is formed on the edge of the back sheet that is opposite to the edge that is joined to the front sheet, so as to extend outwardly therefrom for facilitating grasping of the ticket for pulling of the ticket through the holder.

Finally, it is still further preferred to provide a pocket that is formed on the back sheet, whereby lotto tickets may be stored when not being examined and viewed.

Viewed in another aspect, the present invention provides a combination holder and viewer for a lottery ticket, wherein the ticket has at least one row of selected numbers arranged substantially horizontally across the ticket. The combination holder and viewer comprises a substantially unitary planar article folded upon itself to provide a slot through which the ticket is inserted into the article. The article has a front portion, a back portion and respective side portions; and one of the side portions has an opening formed therein to facilitate a manual grasping of the ticket. With this structure, the article may be held in one hand, and the ticket may be held in the other hand and slidably moved through the article; and means are provided on the article for viewing the row of selected numbers on the ticket.

Preferably, the ticket has a plurality of adjacent rows of selected numbers and is progressively moved through the article.

In a preferred embodiment, the front portion of the article has a window provided with a magnifier for conveniently viewing the rows of numbers on the ticket; and a note pad comprising a "magic slate" is carried on the front portion of the article and is disposed below the magnifier.

Additionally, the article includes a pocket on the back portion thereof, thereby providing a storage compartment for lottery tickets.

These and other objects and advantages of the present invention will become readily apparent from a reading of the following description, taken in conjunction with the enclosed drawings.

BRIEF DESCRIPTION OF THE DRAWINGS

FIG. 5 is a view of the back side of the back sheet of the article of the present invention illustrating the pocket provided as well as its use to hold lottery tickets therein.

FIG. 6 shows the device or article of the present invention being fully unfolded.

FIG. 7 is a perspective view of the article showing where and how a writing implement may be attached thereto.

DESCRIPTION OF PREFERRED EMBODIMENTS

Figures 1, 2:
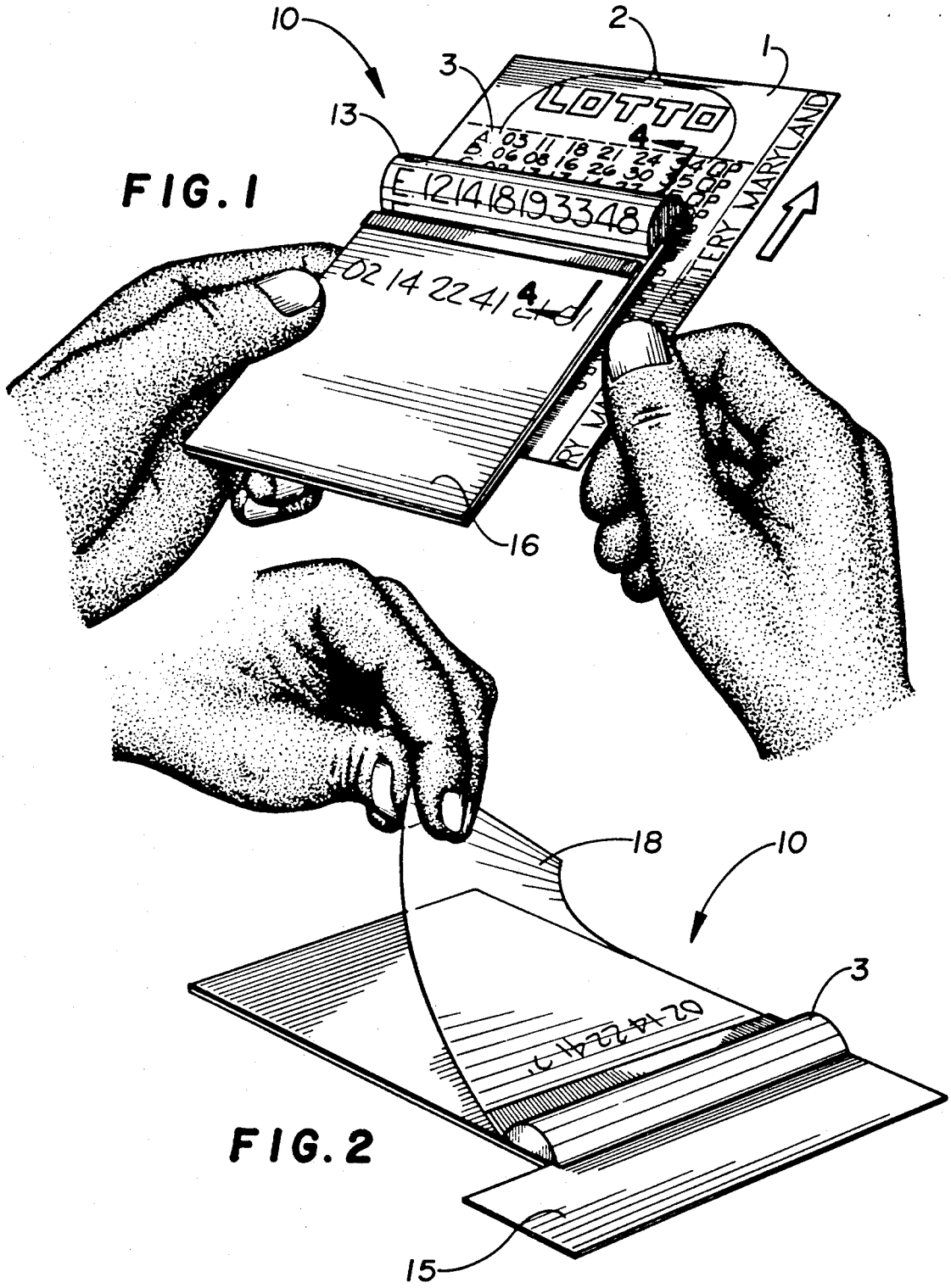
FIG. 1 is a perspective view illustrating the article in use with a line of numbers on the lotto ticket being viewed and compared with the winning combination.
FIG. 2 illustrates the noted winning combination being erased by lifting the top sheet of the "magic slate".

Referring now to the drawings, the lottery (or "lotto") ticket card holder 10 of the present invention is of the type that is particularly useful for viewing lotto tickets 1 of the type having at least one line 2 of printed single or double digit numbers 3 thereon.

The holder 10 has a front sheet 11 and a back sheet 12. The front sheet has a top edge 11*a*, a bottom edge 11*b*, and a pair of parallel side edges 11*c* and 11*d*. Similarly, the back sheet 12 has a top edge 12*a*, a bottom edge 12*b* and a pair of parallel side edges 12*c* and 12*d*. See FIG. 6.

Figure 3:
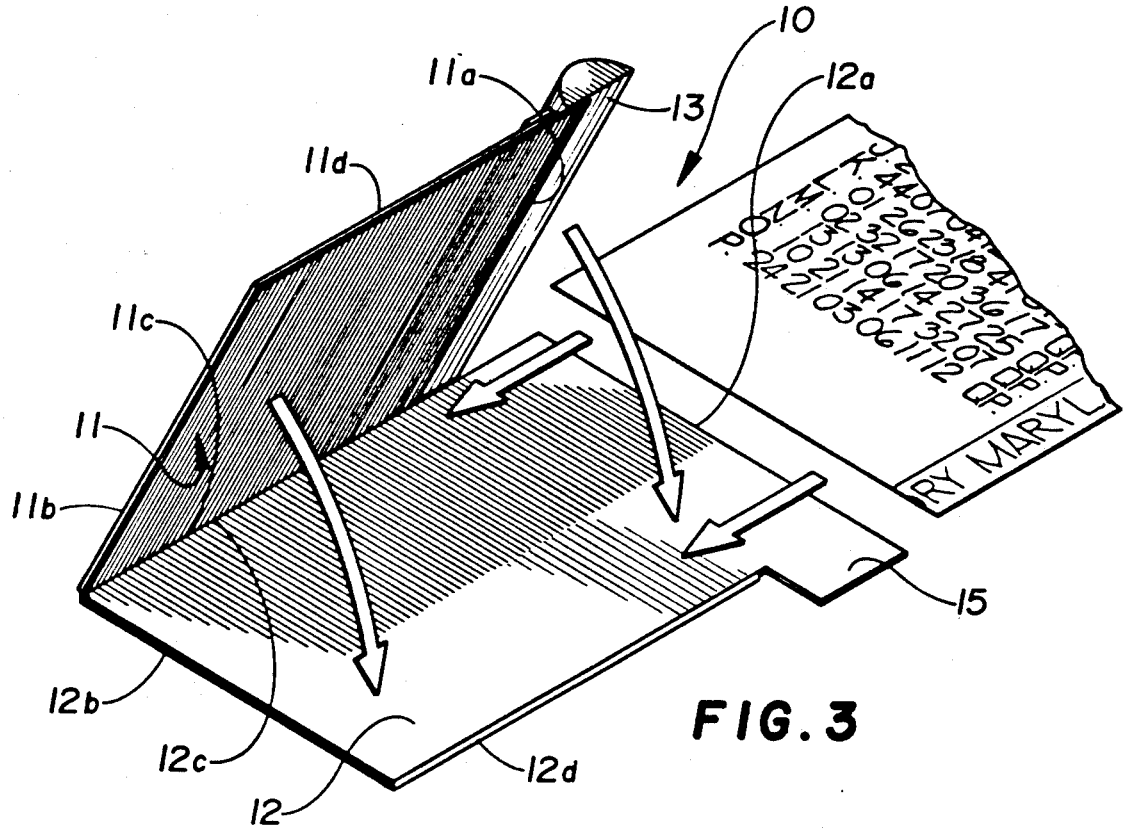
FIG. 3 illustrates the front and back sheets of the article being pivoted open to illustrate the construction thereof.

The front sheet 11 and the back sheet 12 are joined to one another along at least one of the parallel side edges 11*c* and 12*c* which are substantially aligned with one another. In this fashion, the front sheet 11 and the back sheet 12 are joined to one another so as to be openable like a book (FIG. 3). Further in this fashion, the lottery tickets 1 may be held and slid between the front sheets 11 and back sheets 12 from the respective top edges 11*a* and 12*a* to the respective bottom edges 11*b* and 12*b* thereof (FIG. 1).

A transverse magnifier 13 is secured to the front sheet 11. In this manner, as the lotto ticket 1 is slid between the top edges 11*a* and 12*a* and the bottom edges 11*b* and 12*b*, each line 2 of numbers 3 printed on the lotto ticket 1 is magnified by the magnifier. This facilitates the viewing of the line 2 of numbers 3 by the user.

Figure 4:
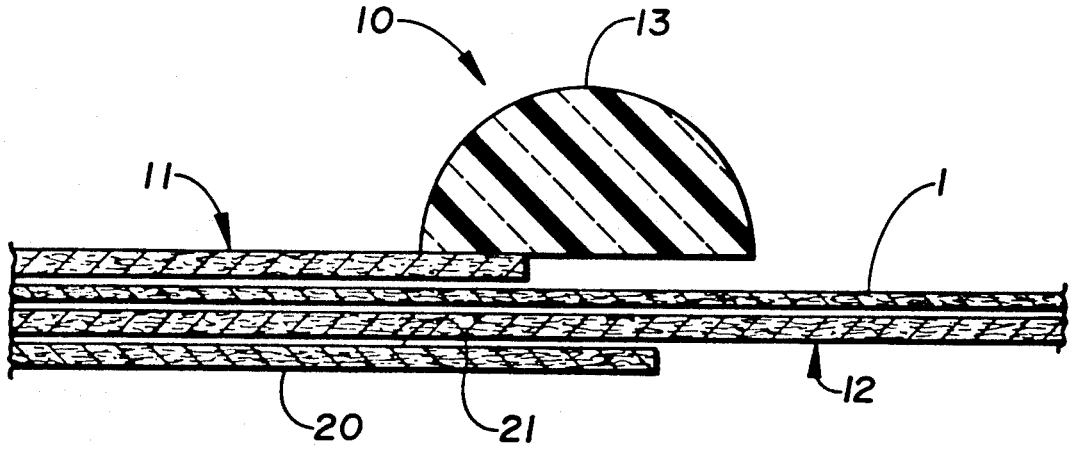
FIG. 4 is a partial cross-section view of the article of the present invention, taken across the lines 4–4 of FIG. 1, showing the construction thereof and the relationship of the lotto ticket therewith.

In the preferred embodiment, the magnifier 13 is secured to the front sheet 11 along the top edge 11*a* thereof, so that the magnifier 13 overhangs the top edge 11*a* (as perhaps best seen in FIGS. 3 and 4). In this manner, as the ticket 1 is being slid and before it disappears below the top edge ll*a*, the line 2 of numbers 3 on the ticket 1 may be viewed.

In the preferred embodiment, the back sheet 12 has a substantially greater height than the front sheet 11. Formed in this fashion, the back sheet 12 of the holder 10 extends above the top edge 11*a* of the front sheet 11. Such an arrangement provides support for the lotto tickets 1 being slid underneath the magnifier 13 for viewing.

It is further preferred that the portion of the back sheet 12 that extends above the top edge 11*a* of the front sheet has a tab 15 formed thereon (as shown more clearly in FIG. 3). This tab 15 is so formed on the free edge 12*d* of the back sheet 12. The tab 15 extends outwardly from the edge l2*d* for facilitating the grasping of the ticket 1 for pulling of the ticket 1 through the holder 10 during use thereof to view the numbers 3 on the ticket 1.

Alternatively, the back sheet 12 may be formed so as to have a cut-out formed therein, such that the edge of the lotto ticket 1 may be grasped for facilitating a pulling of the ticket 1 through the holder 10.

Secured to the front sheet 11 is a means 16 for noting the current winning combination. Preferably, this means 16 is located so as to be substantially adjacent to the transverse magnifier 13. Such positioning permits the user to make an easy comparison of the line 2 of numbers 3 on the lotto ticket 1 being viewed with the current winning combination that is noted on the means 16.

It is further preferred that this means 16 be located below the magnifier 13 immediately adjacent thereto.

The means 16 for noting the current winning combination may be a pad of paper, a small chalkboard or any other such devices that are readily apparent to those skilled in the art. However, it is preferred herein that this means 16 be a "magic slate" which may be "written" on by any hard writing implement 17 provided for this purpose and which writing may be easily and simply "erased" by a lifting of the page 18 (see FIG. 2). In the event that a "magic slate" is provided, it is contemplated that the writing implement 17 provided is a sharpened wooden stick (see FIG. 7). In any event, it is further preferred that the holder 10 further include a clip (a pencil clip) 19 for securing the writing implement 17 to the holder 10 (FIG. 7).

Finally, joined to the back sheet 12 of the holder 10 is a flap 20 (see FIG. 6). Flap 20 is joined to the back sheet 12 so that a pocket 21 is defined between the flap 20 and the back sheet 12. This pocket 21 permits lotto tickets 1 to be stored when they are not being examined and viewed (FIG. 5).

Having thus described the device of the present invention, its use is now described.

First, the user of the holder 10 notes the winning combination on the "magic slate" 16 with the writing implement 17 provided for this purpose.

Then, the user opens the front and back sheets 11 and 12, respectively, and inserts the lotto ticket 1 to be examined therebetween (see FIG. 3). It is contemplated that this lotto ticket 1 will be so inserted as to extend above the top edge 11*a* of the front sheet 11.

Once the ticket 1 is inserted as desired, the user then grips the ticket 1 and pulls or slides the ticket 1 upwardly or downwardly, so that each desired line 2 of numbers 3 printed thereon may be viewed through the magnifier 13. Thus displayed and viewed, the user may then compare the number being viewed through the magnifier 13 with the current winning combination that has been noted on the "magic slate" 16.

Once compared, the user may then remove the ticket 1 therefrom and place the ticket in the pocket 21 or any other convenient place.

Obviously, many modifications may be made to the holder without departing from the basic spirit of the present invention. Accordingly, it will be appreciated by those skilled in the art that within the scope of the appended claims, the invention may be practiced other than has been specifically described herein.

What is claimed is:

1. A lotto ticket card holder for a lotto ticket of the type having at least one line of numbers printed thereon, the holder comprising:

a front sheet having a top edge, a bottom edge and a pair of parallel side edges; p1 a back sheet having a top edge, a bottom edge and a pair of parallel side edges;

the back sheet and the front sheet being joined together along only one of the parallel side edges of each of the front and back sheets, such that the holder may be opened and closed for insertion of a lottery ticket therebetween, and further such that lottery tickets of all sizes may be held and slid between the front and back sheets from the respective top edges to the respective bottom edges thereof, and such that lottery tickets having a width which is greater than the width of the holder may be read within the holder;

a transverse magnifier secured to the front sheet, such that as the lotto ticket is slid each line of the numbers printed on the lotto ticket is magnified by the magnifier for facilitating the viewing of the line of numbers by the user; and means for noting the current winning combination, said means being secured to the front sheet substantially adjacent to the transverse magnifier, whereby easy comparison of the line of numbers on the lotto ticket being viewed and the current winning combination is facilitated.

2. A lotto ticket card holder for a lotto ticket of the type having at least one line of numbers printed thereon, the holder comprising:

a front sheet having a top edge, a bottom edge and a pair of parallel side edges;

a back sheet having a top edge, a bottom edge and a pair of parallel side edges;

the back sheet and the front sheet being joined together along at least one of the parallel side edges of each of the front and back sheets, such that the lottery ticket may .be held and slid between the front and back sheets from the respective top edges to the respective bottom edges thereof;

a transverse magnifier secured to the front sheet, such that as the lotto ticket is slid each line of the numbers printed on the lotto ticket is magnified by the magnifier for facilitating the viewing of the line of numbers by the user; and means for noting the current winning combination, said means being secured to the front sheet substantially adjacent to the transverse magnifier, whereby easy comparison of the line of numbers on the lotto ticket being viewed and the current winning combination is facilitated;

wherein the transverse magnifier is secured along the top edge of the front sheet, so as to overhang the top edge.

3. The lotto ticket card holder of claim 2, further comprised of a viewing slot formed in the front sheet, such that each of the lines of numbers on the lotto tickets may be viewed therethrough, and the transverse magnifier being secured to the front sheet over the viewing slot, whereby the line of numbers on the lotto ticket being viewed are magnified to facilitate the viewing thereof.

4. The lotto ticket card holder of claim 3, wherein the back sheet has a substantially greater height than the front sheet, so that the back sheet of the holder extends above the top edge of the front sheet, whereby lotto tickets being slid underneath the magnifier for viewing are supported.

5. The lotto ticket card holder of claim 4, wherein the portion of the back sheet that extends above the top edge of the front sheet has a tab formed thereon, the said tab being formed on the edge of the back sheet that is opposite to the edge that is joined to the front sheet, so as to extend outwardly therefrom for facilitating grasping of the ticket for pulling of the ticket through the holder.

6. The lotto ticket card holder of claim 3, wherein the means for noting the current winning combination is located below the transverse magnifier.

7. The lotto ticket card holder of claim 3, wherein the means for noting the winning combination is located below the transverse magnifier, immediately adjacent thereto.

8. The lotto ticket card holder of claim 3, wherein the back sheet has a cut-out formed therein, such that the user may grasp the edge of the lotto ticket for facilitating a pulling of the ticket through the holder.

9. The lotto ticket card holder of claim 3, wherein the means for noting the current winning combination includes a "magic slate".

10. The lotto ticket card holder of claim 3, wherein the means for noting the current winning combination includes a writing implement.

11. The lotto ticket card holder of claim 10, further comprising a pencil clip for removably securing the writing implement to the holder.

12. The lotto ticket card holder of claim 3 further including a pocket formed on the back sheet, whereby lotto tickets may be stored when not being examined and viewed.

13. A lotto ticket card holder for a lotto ticket of the type having at least one line of numbers printed thereon, the holder comprising:

a front sheet having a top edge, a bottom edge and a pair of parallel side edges;

a back sheet having a top edge, a bottom edge and a pair of parallel side edges;

the back sheet and the front sheet being joined together along at least one of the parallel side edges of each of the front and back sheets, such that the lottery ticket may be held and slid between the front and back sheets from the respective top edges to the respective bottom edges thereof;

a transverse magnifier secured to the front sheet along the top edge thereof, so as to overhang the top edge, such that as the lotto ticket is slid each line of the numbers printed on the lotto ticket is magnified by the magnifier for facilitating the viewing of the line of numbers by the user;

the back sheet having a substantially greater height than the front sheet, so that the back sheet of the holder extends above the top edge of the front sheet, whereby lotto tickets being slid underneath the magnifier for viewing are supported;

the portion of the back sheet that extends above the top edge of the front sheet having a tab formed thereon, the said tab being formed on the edge of the back sheet that is opposite to the edge that is joined to the front sheet, so as to extend outwardly therefrom for facilitating grasping of the ticket for pulling of the ticket through the holder; and means for noting the current winning combination, said means being secured to the front sheet below and immediately adjacent to the transverse magnifier, whereby easy comparison of the line of numbers on the lotto ticket being viewed and the current winning combination is facilitated.

14. A lotto ticket card holder for a lotto ticket of the type having at least one line of numbers printed thereon, the holder comprising:

a front sheet having a top edge, a bottom edge and a pair of parallel side edges;

a back sheet having a top edge, a bottom edge and a pair of parallel side edges;

the back sheet and the front sheet being joined together along at least one of the parallel side edges of each of the front and back sheets, such that the lottery ticket may be held and slid between the front and back sheets from the respective top edges to the respective bottom edges thereof;

a transverse magnifier secured to the front sheet along the top edge thereof, so as to overhang the top edge, such that as the lotto ticket is slid each line of the numbers printed on the lotto ticket is magnified by the magnifier for facilitating the viewing of the line of numbers by the user;

the back sheet having a substantially greater height than the front sheet, so that the back sheet of the holder extends above the top edge of the front sheet, whereby lotto tickets being slid underneath the magnifier for viewing are supported;

the portion of the back sheet that extends above the top edge of the front sheet having a tab formed thereon, the said tab being formed on the edge of the back sheet that is opposite to the edge that is joined to the front sheet, so as to extend outwardly therefrom for facilitating grasping of the ticket for pulling of the ticket through the holder;

a "magic slate" for noting the current winning combination, the "magic slate" being secured to the front sheet below and immediately adjacent to the transverse magnifier, whereby easy comparison of the line of numbers on the lotto ticket being viewed and the current winning combination is facilitated; and a sharpened wooden stick for writing on the "magic slate".

15. A lotto ticket card holder for a lotto ticket of the type having at least one line of numbers printed thereon, the holder comprising:

a front sheet having a top edge, a bottom edge and a pair of parallel side edges;

a back sheet having a top edge, a bottom edge and a pair of parallel side edges;

the back sheet and the front sheet being joined together along only one of the parallel side edges of each of the front and back sheets, such that the holder may be opened and closed for insertion of a lottery ticket therebetween, and further such that lottery tickets of all sizes may be held and slid between the front and back sheets from the respective top edges to the respective bottom edges thereof, and such that lottery tickets having a width which is greater than the width of the holder may be read within the holder;

a viewing slot formed in the front sheet, such that each of the lines of numbers on the lotto tickets may be viewed therethrough;

a transverse magnifier secured to the front sheet over the viewing slot, such that as the lotto ticket is slid each line of the numbers printed on the lotto ticket is magnified by the magnifier for facilitating the viewing of the line of numbers by the user; and means for noting the current winning combination, said means being secured to the front sheet substantially adjacent to the transverse magnifier, whereby easy comparison of the line of numbers on the lotto ticket being viewed and the current winning combination is facilitated; and a pocket formed on the back sheet, whereby lotto tickets may be stored when not being examined and viewed.

16. A lotto ticket card holder for a lotto ticket of the type having at least one line of numbers printed thereon, the holder comprising:

a front sheet having a top edge, a bottom edge and a pair of parallel side edges;

a back sheet having a top edge, a bottom edge and a pair of parallel side edges;

the back sheet and the front sheet being joined together along at least one of the parallel side edges of each of the front and back sheets, such that the lottery ticket may be held and slid between the front and back sheets from the respective top edges to the respective bottom edges thereof;

a transverse magnifier secured to the front sheet along the top edge of the front sheet, so as to overhang the top edge, such that as the lotto ticket is slid each line of the numbers printed on the lotto ticket is magnified by the magnifier for facilitating the viewing of the line of numbers by the user;

the back sheet having a substantially greater height than the front sheet, so that the back sheet of the holder extends above the top edge of the front sheet, whereby lotto tickets being slid underneath the magnifier for viewing are supported;

means for noting the current winning combination, said means being secured to the front sheet substantially adjacent to the transverse magnifier, whereby easy comparison of the line of numbers on the lotto ticket being viewed and the current winning combination is facilitated; and a pocket formed on the back sheet, whereby lotto tickets may be stored when not being examined and viewed.

17. A combination holder and viewer for a lottery ticket, wherein the ticket has at least one row of selected numbers arranged substantially horizontally across the ticket, the combination holder and viewer comprising a substantially unitary planar article folded upon itself to provide a slot through which the ticket is inserted into the article, the article having a front portion including a top edge, a back portion and respective side portions, one of the side portions having an opening formed therein to facilitate a manual grasping of the ticket, such that the article may be held in one hand, and such that the ticket may be held in the other hand and slidably moved through the article, and a transverse magnifier on the front portion of the article along the top edge thereof, so as to overhang the top edge for viewing the row of selected numbers on the ticket.

18. The combination holder and viewer of claim 17, wherein the ticket has a plurality of adjacent rows of selected numbers, and wherein the ticket is progressively moved through the article.

19. The combination holder and viewer of claim 17, wherein the front portion of the article has a window provided with a magnifier for conveniently viewing the rows of numbers on the ticket.

20. The combination holder and viewer of claim 19, wherein a note pad comprising a "magic slate" is carried on the front portion of the article and is disposed below the magnifier.

21. The combination holder and viewer of claim 17, further including a pocket on the back portion of the article, thereby providing a storage compartment for one or more lottery tickets.

* * * * *